US005714959A

United States Patent [19]

Troy et al.

[11] Patent Number: 5,714,959

[45] Date of Patent: Feb. 3, 1998

[54] GLASS PATCH CELLULAR ANTENNA

[75] Inventors: Staton Edward Troy; Robert Julius Pinto, both of Kokomo, Ind.; Jay James Adams, Hartland, Mich.; Eric Samuel Cavallaro, Indianapolis; Paul William Thiede, Sharpsville, both of Ind.

[73] Assignee: Delco Electronics Corporation, Kokomo, Ind.

[21] Appl. No.: 725,836

[22] Filed: Jul. 26, 1996

Related U.S. Application Data

[63] Continuation of Ser. No. 257,311, Jun. 9, 1994, abandoned.

[51] Int. Cl.[6] ..... H01Q 1/32; H01Q 1/38; H01Q 9/38

[52] U.S. Cl. ..... 343/713; 343/715; 343/829; 343/830

[58] Field of Search ..... 343/713, 752, 343/715, 829, 830; H01Q 1/32, 1/38, 9/38

[56] References Cited

U.S. PATENT DOCUMENTS

| | | | |
|---|---|---|---|
| 3,521,169 | 7/1970 | Turner et al. | 343/752 |
| 4,862,183 | 8/1989 | Blaese | 343/715 |
| 4,931,806 | 6/1990 | Wunderlich | 343/715 |
| 5,083,135 | 1/1992 | Nagy et al. | 343/713 |
| 5,283,589 | 2/1994 | Blevins | 343/713 |
| 5,293,174 | 3/1994 | Kropielnicki et al. | 343/713 |
| 5,363,114 | 11/1994 | Shoemaker | 343/713 |

*Primary Examiner*—Michael C. Wimer
*Attorney, Agent, or Firm*—Jimmy L. Funke

[57] ABSTRACT

A glass patch cellular antenna is provided which can be imprinted as a thin film element on the interior surface of an automobile window. The antenna is physically configured to serve as a coupling element for an optional antenna mast which can be mounted externally on the window opposite the antenna. As a thin film element, the antenna can be factory installed and prewired such that the automobile is cellular ready, in that the installation of an external mast is unnecessary to achieve suitable performance. Yet, an external mast can be readily coupled with the antenna in order to enhance the performance capability of the antenna.

9 Claims, 1 Drawing Sheet

GLASS PATCH CELLULAR ANTENNA

"This is a continuation of application Ser. No. 08/257,311 filed on Jun. 9, 1994, abandoned."

The present invention generally relates to window glass antennas for automobiles. More particularly, this invention relates to a glass patch antenna which is highly efficient when used alone as an antenna, i.e., without an external antenna mast, yet is also configured to serve as a capacitive coupling for an external antenna mast which further improves the efficiency of the antenna system.

BACKGROUND OF THE INVENTION

Mast or whip antennas are known in the art for use in transmitting and receiving radio waves from automobiles. A prior art mast antenna 10 intended for use with an automobile cellular telephone is illustrated in FIG. 1. As is typical, the mast antenna 10 is composed of a mast 12 which is attached to a base 14. The base 14 is mounted to the exterior surface of a rear window 16 of an automobile 18, with the radio signal being transmitted through the window 16 to the mast antenna 10 from a coupling box 20 located on the interior surface of the window 16. While such antennas perform well, their installation costs are relatively high because the interior coupling box 20 must be accurately aligned with the base 14 of the mast antenna 10 in order to ensure adequate transmission of radio wave energy through the window 16. In doing so, the coupling box 20 must also be securely mounted to the interior surface of the window 16, and a suitable cable 22 must be routed from the modular telephone to the coupling box 20.

Further examples of mast antennas are illustrated in U.S. Pat. No. 4,862,183 to Blaese and U.S. Pat. No. 4,931,806 to Wunderlich. Similar to that shown in FIG. 1, each of these patents teaches the use of a coupling box, referred to as an interior connector or module, that must be accurately aligned with the base of a mast antenna in order to achieve efficient transmission through the window glass. Alignment of the coupling box with the base of the mast is particularly critical due to the size and shape of the coupling or transfer plate mounted within the coupling box which forms the capacitive couple for the base of the mast.

In view of the disadvantages noted above, alternatives to the use of an interior coupling box have been proposed in the past. For example, U.S. Pat. No. 5,083,135 to Nagy et al. discloses a thin film antenna which is supported on or within an upper region of an automobile window. The thin film antenna is positioned on the window and is configured to capacitively couple with the body of the automobile so as to enhance the performance of the antenna. The thin film antenna is noted as being much less conspicuous than an external mast, and can advantageously be factory prewired. Yet, to achieve desired levels of efficiency, the thin film antenna taught by Nagy et al. must be rather large, covering a significant area of the window. Consequently, the thin film antenna is described as being sufficiently thin to have a transmittance of at least 70 percent. However, in doing so, ohmic losses can be significant.

In view of the above, it would be desirable if an antenna adapted for use on an automobile were available which did not require a conventional coupling box, did not significantly hinder visibility through a window, and could achieve suitable efficiencies without requiring an external mast. In addition, it would be desirable if such an antenna were configured to couple with an external mast in order to maximize its efficiency, but with less exacting alignment requirements as compared to conventional coupling boxes.

Accordingly, what is needed is a thin film antenna which is configured to be formed on an automobile window and perform well without an external mast, yet minimally effects visibility through the window and is configured to couple with an external mast in order to maximize the efficiency of the thin film antenna. cl SUMMARY OF THE INVENTION It is an object of this invention to provide an antenna suitable for use in automotive cellular communications.

It is a further object of this invention that such an antenna be in the form of an electrically-conductive thin film adhered to an interior surface of a window of an automobile.

It is another object of this invention that such an antenna be configured to be capable of capacitively coupling with a mast which is externally mounted to the window of the automobile.

In accordance with a preferred embodiment of this invention, these and other objects and advantages are accomplished as follows.

According to the present invention, there is provided a glass patch antenna which can be imprinted as a thin film element on the interior surface of an automobile window. The patch antenna is physically configured to perform well without an antenna mast mounted externally on the window opposite the patch antenna, yet also serves as a coupling element for an external antenna mast. As a thin film element, the patch antenna can be factory-installed and prewired. As such, an automobile equipped with the patch antenna is cellular ready since an external mast is optional and unnecessary to achieve suitable performance. Yet, an external mast can later be readily coupled with the patch antenna in order to enhance the performance capability of the antenna.

Generally, the patch antenna includes first and second elements which in use are supported by a window glass panel of an automobile. Each element is formed of an electrically-conductive thin film so as to be capable of conducting an electrical signal to and from an appropriate radio wave receiver and transmitter, respectively. The first element has a substantially rectangular shape and is oriented substantially horizontally on the window glass. The second element has a substantially inverted T-shape and is oriented substantially perpendicular to the first element such that an upper end of the second element is adjacent to a central portion of the first element, yet is electrically isolated from the first element. Importantly, the upper end of the second element is sufficiently close to the first element such that the first and second elements together define an antenna which is also suitable as a coupling element.

A conductor, such as a coaxial cable, is connected to the patch antenna to place the antenna in communication with the system's receiver and transmitter. The cable is preferably attached to the antenna to connect the first element to ground and connect the second element with the transmitter and receiver, such that the second element is supplied with the electrical signal to be broadcast.

As described above, the patch antenna of this invention is capable of at least about 50 percent efficiency. As such, an automobile equipped with the antenna is truly cellular ready, in that the antenna is able of performing suitably in regions having medium cellular coverage—i.e., having adequate cellular coverage with no fringe noise. Therefore, an external antenna mast is not a required component of the antenna of this invention. Yet due to the configuration of the antenna, in which the first and second elements combine to form a coupling element, the efficiency of the antenna can be further improved to nearly 70 percent by securing an external antenna mast to an exterior surface of the window glass panel so as to be capacitively coupled with the coupling element defined by the first and second elements. The relative ease with which an external mast can be aligned and attached to an automobile window equipped with the patch antenna of this invention enables this procedure to be readily performed in the aftermarket or by the automobile dealer. In the event that the mast should fall off, the efficiency of the patch antenna will permit most cellular calls to be completed.

In addition to the operational advantages of the patch antenna of this invention, other advantages include cost savings to the automobile manufacturer. Printed thin film antennas such as the patch antenna of this invention are generally less costly than conventional antennas composed of a coupling box and mast. Installation labor costs are also significantly less in that a coupling box is not required to be attached to the interior surface of a window glass so as to be accurately aligned with an external mast. In addition, the patch antenna of this invention is relatively small in size, making it much less conspicuous than prior art mast and thin film antennas.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Illustrated in FIGS. 2 through 5*a* and 5*b* is a thin film patch antenna which is capable of effectively serving as an automobile cellular antenna without requiring an external antenna mast. In accordance with this invention, the patch antenna is also physically configured to serve as a coupling element for an optional antenna mast which can be mounted externally on the window opposite the patch antenna. The patch antenna can be factory prewired such that an automobile equipped with the antenna is cellular ready as manufactured, in that the installation of an external mast is unnecessary to achieve suitable performance of a cellular telephone. Yet, an external mast can be readily coupled with the patch antenna in order to enhance the overall performance capability of the antenna system.

Figure 2:
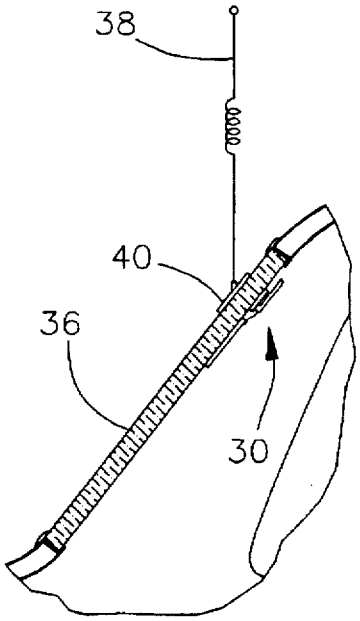
FIG. 2 is a cross sectional view of a cellular antenna composed of an interior patch antenna and an exterior antenna mast in accordance with a preferred embodiment of this invention.
Figure 3:
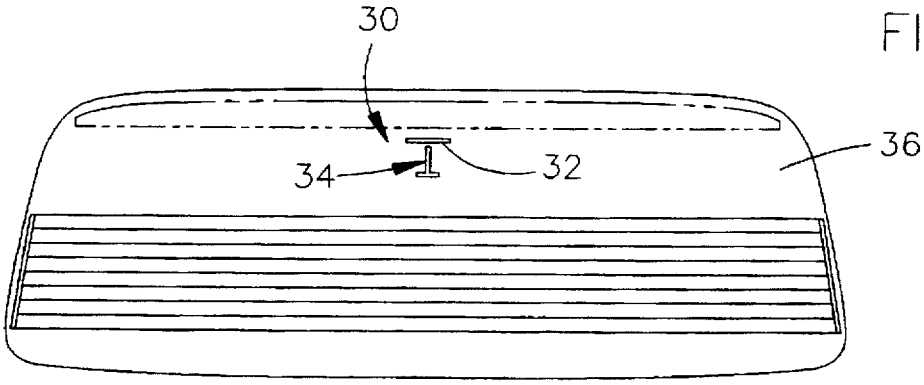
FIG. 3 is a rear view of an automobile rear window which is equipped with the patch antenna of this invention without the exterior antenna mast shown in FIG. 2.
Figure 4:
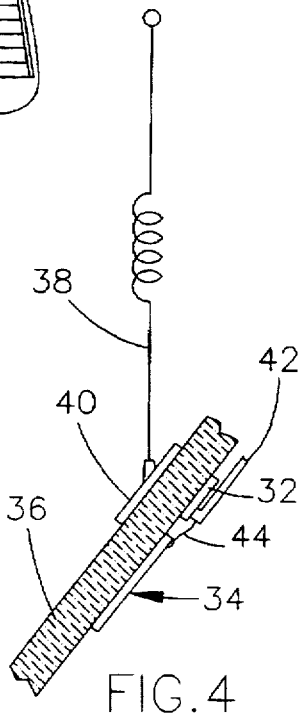
FIG. 4 is a detailed cross-sectional view of the cellular antenna of FIG. 2.

As represented in FIGS. 2 and 4, the antenna of this invention includes a patch antenna 30 and an optional antenna mast 38. The patch antenna 30 is formed on an interior surface of an automobile window 36 while the antenna mast 38 is secured to an exterior surface of the window 36 via a base 40. The patch antenna 30 includes a first thin film element 32 and a second thin film element 34 which are imprinted directly on the interior surface of the window 36. Each of the elements 32 and 34 is formed to be electrically conductive so as to be capable of conducting an electrical signal to and from an appropriate radio wave receiver and transmitter, respectively. Suitable materials for this purpose include single layer films of indium-tin-oxide, copper, silver and others, or multiple layer films having a heat-reflecting capability, such as films formed of layers of silver and titanium dioxide, all of which are known in the art. Under some circumstances, it may be preferable that the electrically-conductive film material be relatively transparent in order to maximize visibility through the window 36. Such materials are formed as thin as practicable to achieve the desired transparency, typically on the order of at least about 70 percent transmittance, while simultaneously being of sufficient thickness to minimize ohmic loss. Yet, as is apparent from the limited size of the patch antenna 30 shown in the Figures, the use of a transparent electrically-conductive material is not absolutely necessary in accordance with this invention. As represented in FIG. 3, the placement of the patch antenna 30 near the central upper edge of the window 36 also serves to minimize interference with visibility through the window 36. As such, a film thickness of about 0.2 to about 0.4 millimeter is believed to be suitable in the practice of this invention, though lesser or greater thicknesses could also be employed.

As thin films, the elements 32 and 34 can be readily formed on window glass using sputtering or other physical or chemical vapor deposition techniques, in accordance with known practices. Alternatively, the elements 32 and 34 can be formed by depositing an electrically conductive film onto a polymer sheet, which is then adhered to the window 36 using a known adhesive, such as a pressure sensitive adhesive.

As more readily seen in FIG. 4, a conductor, such as a coaxial cable 42, is connected to the patch antenna 30 to electrically connect the patch antenna 30 to a radio wave receiver and transmitter (not shown) associated with the automobile's communication system which, in this example, would be a cellular telephone. The cable 42 is preferably a coaxial cable, such as RG-58, with an inner conductor 44 and an outer conductor (not shown), which is typically the cable shield. The outer conductor of the cable 42 is attached, such as by solder, to the first element 32 to electrically connect the first element 32 to ground. In addition, the end of the cable 42 is preferably secured by being bonded directly to the first element 32 with a suitable adhesive, such as an epoxy. The inner conductor 44 is attached, such as by solder, to the second element 34 so as to electrically connect the second element 34 with the transmitter and receiver. As such, the second element 34 is the primary antenna element in that it is supplied with and conducts the electrical signal broadcast by the transmitter and supplied to the receiver.

Figure 5B:
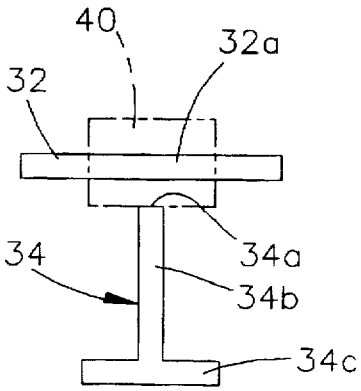
FIGS. 5*a* and 5*b* illustrate preferred alignment positions for the base of the antenna mast with the patch antenna of FIGS. 2 and 4 in accordance with this invention.
Figure 5A:
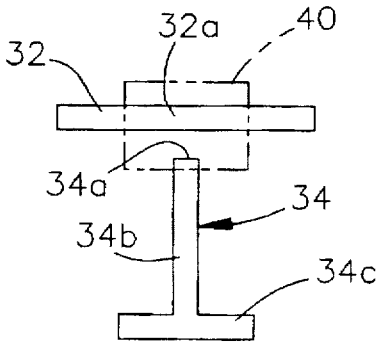

As shown in FIGS. 3, 5*a* and 5*b*, the first element 32 preferably has a substantially rectangular shape and is oriented to be substantially horizontal on the window 36. In contrast, the second element 34 has a substantially inverted T-shape, and is oriented on the window 36 to be substantially perpendicular to the first element 32 such that an upper end 34*a* of the second element 34 is adjacent to a central portion 32*a* of the first element 32, yet is physically spaced from the first element 32. Importantly, the upper end 34*a* of the second element 34 is sufficiently close to the first element 32 such that the first and second elements 32 and 34 together are able to form and serve as the patch antenna 30. In addition, the upper end 34*a* of the second element 34 must also be sufficiently close to the first element 32 in order to effectively form a coupling element for the base 40 of the antenna mast 38 shown in FIGS. 2 and 4. In practice, a distance of about 3.175 millimeters between the first member 32 and the upper end 34*a* of the second element 34 has been found to be most suitable, though a range of about two to about ten millimeters is believed to be suitable. Within the above range, a preferred dimension for the gap between the elements 32 and 34 will depend on their specific shapes and dimensions.

The shapes and dimensions of the first and second elements 32 and 34 are important in order to achieve the desired performance capability for the patch antenna 30. Preferred dimensions for the elements 32 and 34 for a given application depend on the wavelength and bandwidth requirements of the cellular telephone band (824 to 894 MHz). In a preferred embodiment, the first element 32 has a horizontal length of about six centimeters, though it is believed that this dimension can range between about four and about nine centimeters, and a width of about 0.64 centimeters, though widths of about 0.32 to about 1 centimeter are also believed to be suitable. Because the second element 34 has an inverted T-shape, the second element 34 generally includes a substantially vertical upper member 34*b* and a substantially horizontal base member 34*c*. The base member 34*c* serves as a capacitive top-loading section so as to allow the upper member 34*b* to be relatively short. As shown, the upper and base members 34*b* and 34*c* are preferably formed as a unitary piece, though it is foreseeable that these members 34*b* and 34*c* could be formed as discreet patches which would be individually placed and oriented on the glass 36. The base member 34*c* preferably has a length of about 2.5 centimeters, though lengths of up to about nine centimeters are believed suitable. If so desired, the base member 34*c* can be significantly shorter or omitted, but at the expense of requiring the upper member 34*b* to be longer. The upper member 34*b* preferably has a length which is sufficient to achieve a distance of about six centimeters from the upper end 34*a* of the upper member 34*b* to the lower edge of the base member 34*c*. It is believed this distance can vary from about three to about seventeen centimeters with suitable results. The widths of the first element 32 and the upper and base members 34*b* and 34*c* of the second element 34 are not generally as critical as those noted above. Generally, a width of about 0.6 centimeter is believed to be adequate for each of these components, though widths of about 0.2 to about 2 centimeters are also believed to be suitable.

As described above, the patch antenna 30 of this invention is independently capable of at least about 50 percent efficiency. As such, an automobile equipped with the patch antenna 30 is cellular ready, in that the patch antenna 30 is able of performing suitably in most areas, i.e., those regions having medium cellular coverage. Therefore, as represented by FIG. 3, the external antenna mast 38 shown in FIGS. 2 and 4 is not a required component of the antenna of this invention. In tests performed with the patch antenna 30 of this invention formed as a copper thin film sized in accordance with the preferred dimensions noted above, an average Rx (received signal strength) level of about −62 decibels (dBm) at a radio signal frequency of about 880.14 megahertz was achieved, indicating an efficiency in excess of 50 percent. Yet, because the patch antenna 30 of this invention is specifically configured to form a coupling element for an external mast 38, the efficiency of the antenna can be further improved to nearly 70 percent by securing the base 40 of the antenna mast 38 to the exterior surface of the window 36 so as to be capacitively coupled with the first and second elements 32 and 34.

The location of the base 40 of the antenna mast 38 is important in order to optimize the performance of the antenna. A suitable position of the base 40 is represented in FIG. 5*a*, which illustrates the base 40, in phantom, as straddling the first element 32 and the upper end 34*a* of the second element 34. In tests with the antenna mast 38 and base 40 positioned as shown in FIG. 5*a* with the patch antenna 30 used in the test described above, an average Rx level of about −64 dBm at the same radio frequency was achieved. FIG. 5*b* shows a more preferred position for the base 40 over the patch antenna 30. In this position, the lower edge of the base 40 is aligned with the edge of the upper end 34*a* of the second element 34. In this position, the antenna exhibited an average Rx level of about −62.5 dBm, an improvement of about 2 dB. The superior performance of the position of FIG. 5*b* is due to a more efficient coupling between the patch antenna 30 and the base 40 of the external mast 38.

From the above, it can be seen that a significant advantage of the patch antenna 30 of this invention is that it is independently capable of performing with at least about 50 percent efficiency. As such, an automobile equipped with the patch antenna 30 is cellular ready, in that the patch antenna 30 is able of performing suitably under most conditions, i.e., within those geographical regions having medium cellular coverage. Therefore, as represented by FIG. 3, the external antenna mast 38 shown in FIGS. 2 and 4 is not a required component of the antenna of this invention. Yet due to the configuration of the patch antenna 30, in which the first and second elements 32 and 34 combine to form a coupling element for the external mast 38, the efficiency of the antenna can be further improved to nearly 70 percent by securing the base 40 of the antenna mast 38 to the exterior surface of the window 36 so as to be capacitively coupled with the first and second elements 32 and 34. As an additional advantage of this invention, the installation of the external mast 38 is simplified, in that less exacting alignment is required as compared to conventional coupling boxes. As such, installation of the external mast 38 can be readily performed in the aftermarket or by the automobile dealer. In the event that the mast 38 should fall off, the efficiency of the patch antenna 30 will still permit most cellular calls to be completed.

Figure 1:
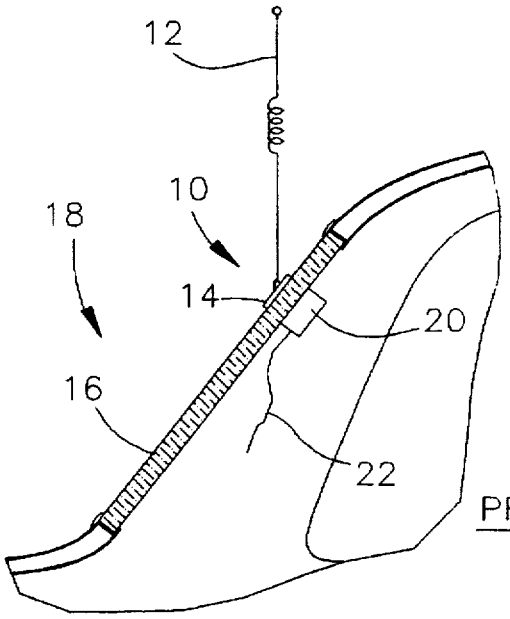
FIG. 1 PRIOR ART
FIG. 1 is a cross sectional view of a prior art cellular antenna composed of an interior coupling box and an exterior antenna mast.

In addition to the operational advantages of the antenna of this invention, other advantages include cost savings to the automobile manufacturer. Printed thin film antennas such as the patch antenna 30 of this invention are generally less costly than conventional antennas composed of a coupling box and mast, such as that shown in FIG. 1. Installation labor costs are also significantly less in that a coupling box is not required to be attached to the interior surface of a window glass so as to be accurately aligned with the base of the external mast. In addition, the patch antenna 30 of this invention is relatively small in size, making it much less conspicuous than conventional mast antennas and most prior art thin film antennas.

While our invention has been described in terms of a preferred embodiment, it is apparent that other forms could be adopted by one skilled in the art; for example, by modifying the shapes and dimensions of the first and second elements 32 and 34, the manner in which the elements 32 and 34 are formed on the window 36, and the manner in which the elements 32 and 34 are electrically connected to the cellular system. Accordingly, the scope of our invention is to be limited only by the following claims.

The embodiments of the invention in which an exclusive property or privilege is claimed are defined as follows:

1. An antenna for receiving and transmitting electromagnetic radio waves from an automobile having a window glass panel, the antenna comprising:

an electrically-conductive thin film ground element supported by the window glass panel of the automobile and physically spaced from an edge of the window glass panel, the ground element having a substantially rectangular shape and being oriented substantially horizontally;

an electrically-conductive thin film primary element supported by the window glass panel and physically separated from the ground element, the primary element having a substantially inverted T-shape so as to have a rectangular-shaped first portion oriented substantially perpendicular to the ground element and a rectangular-shaped second portion oriented substantially parallel to the ground element, the first portion being between the ground element and the second portion such that an upper edge of the first portion is adjacent to a central portion of the ground element and physically spaced from the ground element, the upper edge of the first portion being sufficiently close to the ground element such that the primary and ground elements together form an antenna having an efficiency in excess of 50 percent, the primary and ground elements further forming a capacitive coupling element that is configured to capacitively couple to an external mast antenna secured to an exterior surface of the window glass panel.

2. An antenna as recited in claim 1 wherein the upper edge of the first portion is spaced about two to about ten millimeters from the ground element.

3. An antenna as recited in claim 1 wherein the primary and ground elements comprise thin metallic films which are deposited directly on the window glass panel.

4. An antenna for receiving and transmitting electromagnetic radio waves from an automobile having a window glass panel, the antenna comprising:

a ground element formed of a thin film of electrically conductive material and disposed on an interior surface of the window glass panel of the automobile, the ground element having a substantially rectangular shape and being oriented substantially horizontally;

a primary element formed of a thin film of the electrically conductive material and disposed on the interior surface of the window glass panel, the primary element being physically separated from the ground element, the primary element having a substantially inverted T-shape so as to have a rectangular-shaped first portion oriented substantially perpendicular to the ground element and a rectangular-shaped second portion oriented substantially parallel to the ground element, the first portion being between the ground element and the second portion such that an upper edge of the first portion is adjacent to a central portion of the ground element and physically spaced from the ground element, the upper edge of the first portion of the primary element being spaced about two to about ten millimeters from the ground element such that the ground and primary elements together form an antenna having an efficiency in excess of 50 percent, the primary and ground elements further forming a capacitive coupling element that is configured to capacitively couple to an external mast antenna secured to an exterior surface of the window glass panel;

means in electrical contact with the ground element for electrically connecting the ground element to ground; and means in electrical contact with the primary element for supplying an electrical signal to the primary element.

5. An antenna as recited in claim 4 wherein the primary and ground elements comprise thin metallic films which are deposited directly on the window glass panel.

6. An antenna as recited in claim 4 further comprising an antenna mast secured to an exterior surface of the window glass panel so as to be capacitively coupled with the capacitive coupling element, the antenna mast comprising a base, the base being positioned on the exterior surface of the window glass panel so as to straddle the central portion of the ground element.

7. An antenna for receiving and transmitting electromagnetic radio waves from an automobile having a window glass panel, the antenna comprising:

a ground element formed of a thin film of electrically conductive material and disposed on an interior surface of the window glass panel of the automobile, the ground element having a substantially rectangular shape and being oriented substantially horizontally;

a primary element formed of a thin film of the electrically conductive material and disposed on the interior surface of the window glass panel, the primary element being physically separated from the ground element, the primary element having a substantially inverted T-shape so as to have a rectangular-shaped first portion oriented substantially perpendicular to the ground element and a rectangular-shaped second portion oriented substantially parallel to the ground element, the first portion being between the ground element and the second portion such that an upper edge of the first portion is adjacent to a central portion of the ground element and physically spaced from the ground element, the upper edge of the first portion of the primary element being spaced about two to about ten millimeters from the ground element such that the primary and ground elements together form an antenna having an efficiency in excess of 50 percent, the primary and ground elements further forming a capacitive coupling element;

a coaxial cable having an outer conductor electrically contacting the ground element for electrically connecting the ground element to ground, and an inner conductor electrically contacting the primary element for transmitting an electrical signal to and from the primary element; and an antenna mast secured to an exterior surface of the window glass panel so as to be capacitively coupled with the capacitive coupling element defined by the primary and ground elements, the antenna mast having a base that straddles the central portion of the ground element.

8. An antenna as recited in claim 7 wherein the base is symmetrically disposed over the central portion of the ground element and a lower edge of the base is aligned with the upper edge of the ground element.

9. An antenna as recited in claim 7 wherein the base overlaps the upper edge of the first portion of the primary element.

* * * * *